United States Patent [19]

Bothun et al.

[11] Patent Number: 4,687,122

[45] Date of Patent: Aug. 18, 1987

[54] SELF-BLEEDING BUNG DISPENSER VALVE

[75] Inventors: Eugene L. Bothun, Loveland; Brent S. Hine, Lakewood, both of Colo.

[73] Assignee: Sit-N-Sip, Inc., Denver, Colo.

[21] Appl. No.: 778,211

[22] Filed: Sep. 20, 1985

[51] Int. Cl.[4] ..... B67D 3/00

[52] U.S. Cl. ..... 222/183; 222/192; 222/484; 222/518; 297/188

[58] Field of Search ..... 222/483, 484, 487, 501, 222/511, 518, 545, 559, 183, 192; 251/322, 323; 297/188

[56] References Cited

U.S. PATENT DOCUMENTS

| | | | |
|---|---|---|---|
| 159,054 | 1/1875 | Warker | 222/487 X |
| 1,494,043 | 5/1924 | Vogt | 222/484 |
| 2,713,988 | 7/1955 | Kitterman | 251/322 |
| 2,915,224 | 12/1959 | Beall | 222/484 X |
| 2,939,611 | 6/1960 | Nebinger | 222/484 X |
| 3,187,770 | 6/1965 | Plamann | 222/484 X |
| 3,560,047 | 2/1971 | Davis | 297/188 |
| 4,474,407 | 10/1984 | Nazar | 297/188 X |

FOREIGN PATENT DOCUMENTS

| | | | |
|---|---|---|---|
| 135420 | 7/1947 | Australia | 222/518 |

*Primary Examiner*—Joseph J. Rolla
*Assistant Examiner*—Frederick R. Handren
*Attorney, Agent, or Firm*—James R. Young

[57] ABSTRACT

A combination seat cushion and liquid container has a self-bleeding bung dispensing valve positioned in a single bung hole of the container for dispensing liquid from the container while bleeding air into the container. The valve structure includes an air bleed valve and a liquid drain valve, both of which open simultaneously upon the depression of a button in the bung hole and which automatically close simultaneously upon release of the pressure on the button.

8 Claims, 5 Drawing Figures

SELF-BLEEDING BUNG DISPENSER VALVE

BACKGROUND OF THE INVENTION

1. Field of the Invention

The present invention relates generally to valves for portable containers and more specifically to a self-bleeding bung dispenser valve for draining liquid through the bung hole of the container while simultaneously bleeding air into the container through the same bung hole.

2. Description of the Prior Art

It is becoming common for people to carry along seat cushions for use on hard benches and bleachers when attending athletic events, picnics, and the like, where the seating is likely to be hard and uncomfortable. It is also common for such persons to carry along an insulated liquid container for dispensing hot or cold beverages during the athletic event, picnic, or the like.

There have been several attempts to combine such a seat cushion and such a container into an integral unit with the container embedded inside the seat cushion. For example, the U.S. Pat. No. 3,560,047, issued to J. Davis, discloses a container seat or cushion that has a container in the seat for carrying and dispensing liquids. However, this Davis container seat has two openings—a bung hole in the back for filling the container and a dispensing valve in the front for dispensing the liquid. Further, the dispensing valve shown in the Davis seat container is of the lever operated pet cock type that does work, however, it is susceptible to bumping or unknowingly nudging the valve lever open which can result in leakage or loss of the liquid contents from the container.

Another more recent approach is disclosed in the U.S. Pat. No. 3,763,972, issued to M. Karzman. In this Karzman patent, a seat cushion is provided with structurally strong panels or shells around an interior compartment for carrying bottled beverages.

One of the problems with the prior art combination seat cushion/container devices is that they require two openings—one for filling and another for dispensing. Also, it is, of course, necessary to bleed air into the container while liquid is dispensed. A relatively flat container structure is required to fit inside a seat cushion, so it has to be used in a horizontal position for dispensing liquid as a person sits on it. On the other hand, it is likely to be carried in a vertical position and perhaps transported in any position, including upside down. There has heretofore been no practical dispensing valve and air bleed structure that is effective and easy to use, yet which seals when not in use and is not subject to accidental leakage. It is also preferred that such a valve structure have a positive sealing push buttom type actuator that automatically returns to a normally closed position when not dispensing, as opposed to a lever actuated pet cock type valve that can be accidentally bumped or left open.

SUMMARY OF THE INVENTION

Accordingly, it is a general object of the present invention to provide a container with a dispenser valve that has only one bung hole, yet which dispenses liquid effectively from the container while allowing air to bleed into the container.

A more specific object of the present invention is to provide an effective self-bleeding bung dispenser valve for a container that is removeably positionable in a bung hole of a container for dispensing liquid from the container while simultaneously bleeding air into the container through the same bung hole.

It is also a specific object of the present invention to provide a self-bleeding bung dispenser valve that is biased to a normally closed position so that it automatically closes the bung hole and remains closed when not in use.

Additional objects, advantages, and novel features of the invention are set forth in part in the description that follows, and in part will become apparent to those skilled in the art upon examination of the following specification or may be learned by the practice of the invention. The objects and advantages of the invention may be realized and attained by means of the instrumentalities and in combinations particularly pointed out in the appended claims.

To achieve the foregoing and other objects in accordance with the purposes of the present invention, as embodied and broadly described herein, the apparatus of this invention may comprise a container having one bung hole with a valve body removeably retained therein. The valve body has a bleed air conduit therethrough and a liquid drain conduit therethrough. A bleed air valve is positioned in the air conduit, and a liquid drain valve is positioned in the drain conduit. Both the bleed air valve and the liquid drain valve are connected to a common valve actuator so that they are both opened and closed simultaneously. These valves are preferably biased to a normally closed position to prevent accidental opening or leakage.

BRIEF DESCRIPTION OF THE DRAWINGS

The accompanying drawings, which are incorporated, and form a part of the specifications illustrate the preferred embodiments of the present invention, and together with the description, serve to explain the principles of the invention. In the drawings.

DETAILED DESCRIPTION OF THE PREFERRED EMBODIMENTS

Figure 1:
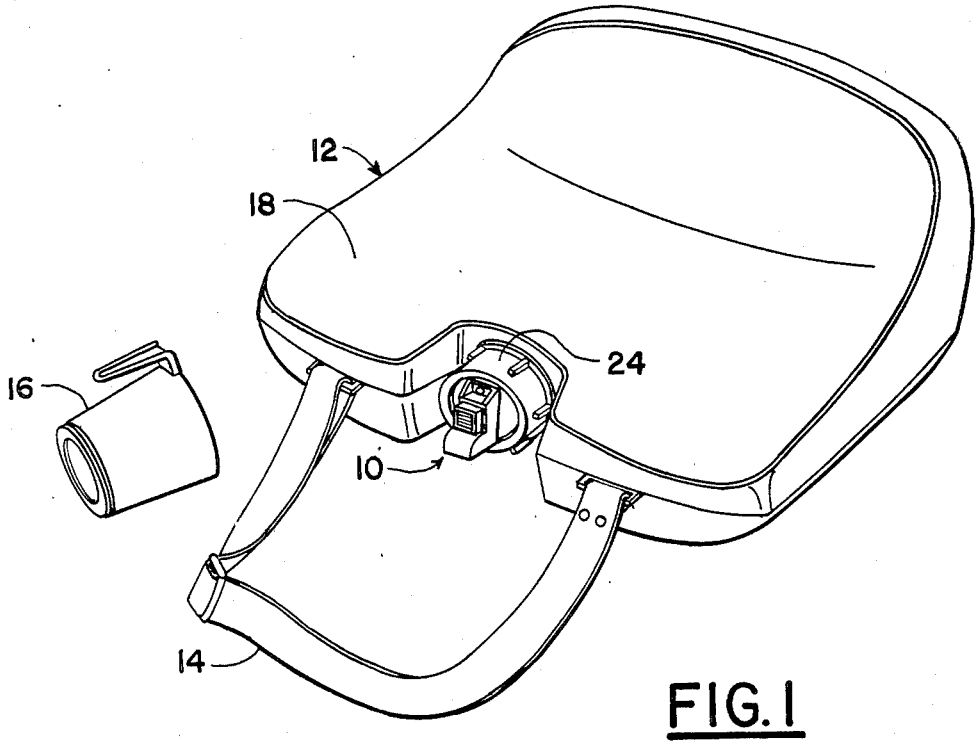
FIG. 1 is a perspective view of a combination liquid container and seat cushion utilizing the self-bleeding bung dispenser valve of the present invention.

A combination seat cushion and liquid container 12 is shown in FIG. 1 with the self-bleeding bung dispenser valve 10 of the present invention positioned in the bung hole of the container. This seat cushion/container 12 includes an insulated cushion 18 in the form of a seat with a liquid container enclosed or embedded therein under the seat surface. The self-bleeding bung dispenser valve 10 according to the present invention is removeably fastened in the bung hole of the container by a threaded ring or nut 24, as will be described more fully below. A cup 16 can be removeably inserted over the retainer ring 24 for storage, or it can be removed and used for receiving liquid dispensed from the valve 10 for drinking. A flexible strap 14 is attached to the front of the seat 12 for carrying the seat and container combination 12.

It is preferred for reasons of aesthetics, design practicalities, and preventing leakage, to provide only one bung hole in the container embedded in the seat 12. Also, while it is of course necessary to provide air bleed means for bleeding air into the container as liquid is dispensed therefrom through the valve 10, it is preferred that such air bleed means be closed and sealed whenever liquid is not being dispensed from the container. This feature is necessary because of the nature of the container in its ordinary circumstances of use require that the container be leak-proof in any position, including vertical, horizontal, or even upside down. The self-bleeding bung dispenser valve 10 according to the present invention meets these needs.

Figure 2:
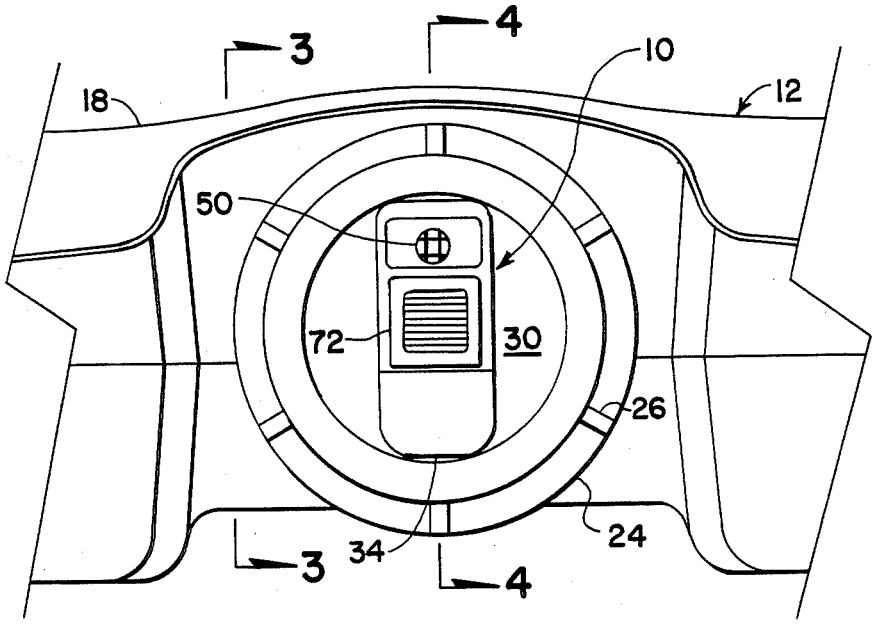
FIG. 2 is a front elevation view of the self-bleeding bung dispenser valve positioned in the bung hole of the combination container seat cushion shown in FIG. 1.

The self-bleeding bung dispenser valve 10 according to the present invention is shown in an enlarged front elevation view in FIG. 2 with the adjacent surrounding portion of the container seat 12. The valve 10 is an integral unit having an air intake hole 50, an actuator button 72, and a liquid dispenser spout 34 all mounted on a main valve body 30. The valve body 30 is fastened onto the bung hole of the container by the threaded ring or nut 24. The nut 24 has a plurality of flanges protruding radially therefrom around its peripheral surface for aiding gripping the nut 24 for screwing it onto and off the bung hole of the container.

Figure 3:
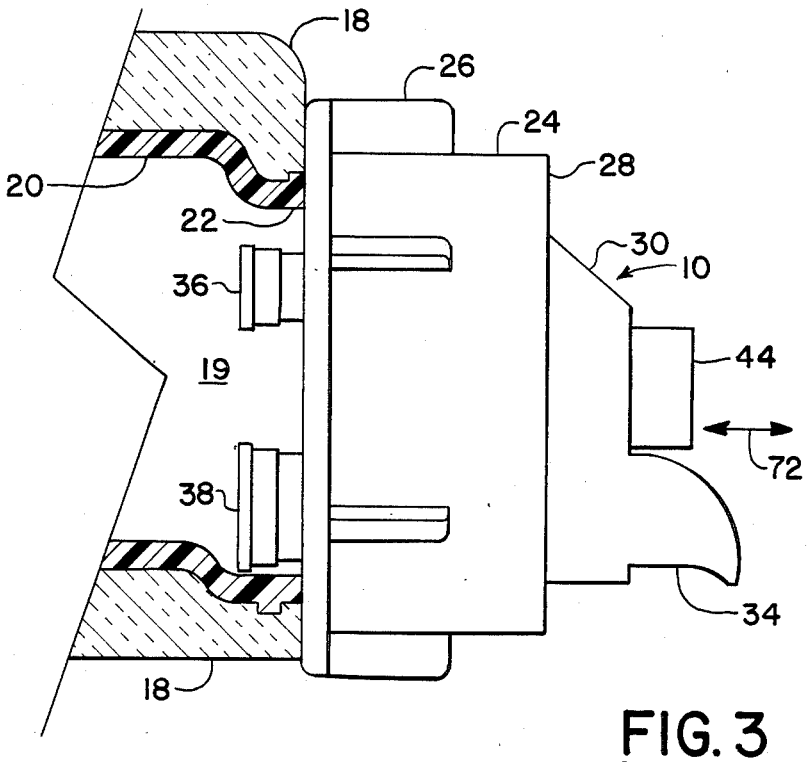
FIG. 3 is a side elevation view of the self-bleeding bung dispenser valve of the present invention taken substantially along line 3—3 of FIG. 2.
Figure 4:
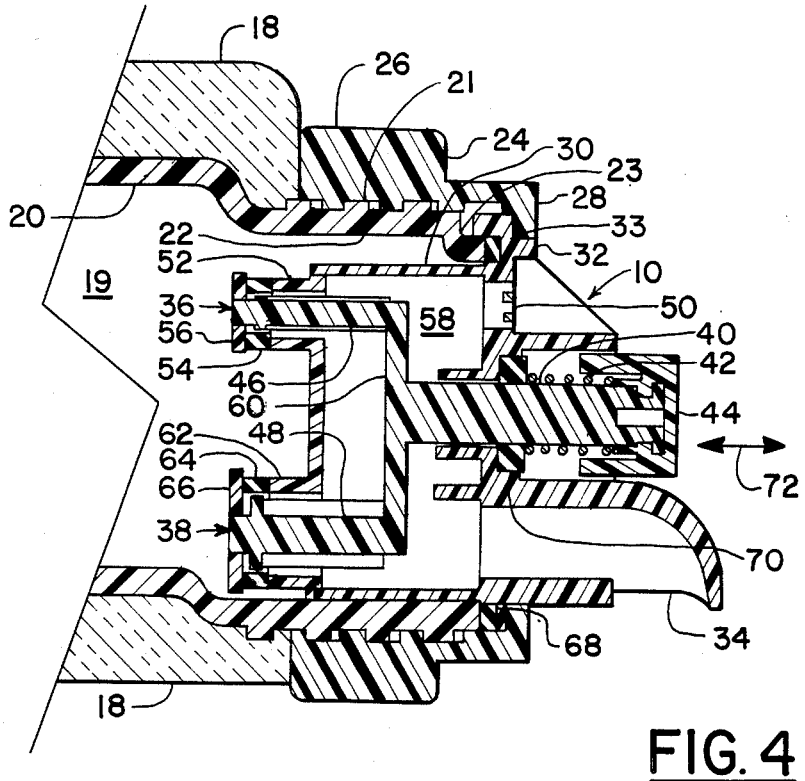
FIG. 4 is a cross-sectional view of the self-bleeding bung dispenser valve of the present invention taken substantially along line 4—4 of FIG. 2.

The details of the valve 10 and its attachment to the container 20 inside the insulated seat padding or cushion 18 is better illustrated in FIGS. 3 and 4. As mentioned above, the container 20 preferably forms the structural unit of the seat 12 and is covered with a layer of insulated foam or cushion 18, both for providing comfort to the person sitting on the seat as well as to insulate the container 20. The front of the container 20 is in the form of a bung hole 22 with external threads 21 protruding forwardly from the cushion 18. The valve body 30 of the valve 10 according to the present invention is inserted into the bung hole with its peripheral shoulder 32 abutted against a gasket 68 around the peripheral surface opening of the bung hole 22. The internally threaded retainer ring or nut 24 is then screwed onto the external threads 21 of the bung hole 22 until its collar 28 squeezes the shoulder 32 of the valve body 30 against the gasket 68 for sealing it in that position. A notch 23 in the end of bung hole 22 receives an enlarged portion 33 of the valve body 30 in proper orientation as the nut 24 is being attached.

The valve body 30 defines an enclosed chamber 58 positioned in the bung hole 22 with the spout 34 opening from the bottom portion of the chamber 58. There are two internal openings into the chamber 58. The upper opening or conduit 52 forms the air bleed opening, and the lower conduit 62 forms the liquid draining conduit. An air bleed valve 36 is positioned in the air bleed conduit 52, and a liquid outlet valve 38 is positioned in the liquid drain conduit 62.

An elongated valve stem 40 protrudes through a seal 70 in the front portion of the valve body 30 into chamber 58. In the chamber 58, the valve stem 40 terminates in a vertically elongated flat plate 60. A push button cap 44 is attached to the external end of the valve stem 40. A coiled compression spring 42 is positioned around the valve stem 40 between the valve housing 30 and the button cap 44 for biasing the valve stem 40 outwardly.

Inside the chamber 58, a bleed valve stem 46 extends rearwardly from the top of the elongated plate 60 through the bleed conduit 52 and into the interior 19 of the container 20. Likewise, an elongated liquid valve stem 48 extends from the bottom of the elongated plate 60 through the liquid drain conduit 62 and into the interior 19 of container 20. A bleed valve seal 54 is positioned between a bleed valve keeper 56 fastened onto the interior end of the bleed valve stem 46. Similarly, a liquid valve seal 64 is positioned between the liquid drain conduit 62 and a liquid valve keeper 66 fastened on the interior end of the liquid valve stem 48.

In operation, the spring 42 biases the main valve stem 40 outwardly, thereby squeezing the bleed valve seal 54 and the liquid valve seal 64 against the respective conduits 52, 62. In this position, both the bleed valve 56 and the liquid drain valve 38 are closed and sealed so that no liquid can escape or leak from the interior 19 of the container 20. However, when a person desires to dispense liquid from the container 20, the button cap 44 can be pushed inwardly as indicated by the arrow 72 against the bias of spring 42. Such inward movement pushes the bleed valve 36 and liquid drain valve 38 away from the respective conduits 52, 62 to open the bleed valve 36 and liquid drain valve 38 simultaneously. Therefore, when the button 44 is pushed inwardly, liquid can drain from the container 20 through the conduit 62 and out the spout 34.

At the same time, air can bleed through the vent hole 50 and conduit 52 into the container. Since the liquid drain valve 38 and conduit 62 are positioned below the air bleed valve 36 and conduit 52, and the spout 34 is sufficiently large to drain away any liquid passing through the conduits 62, there will be no interference or blockage of air flow through the higher conduit 52 into the container 20.

Then, when the desired quantity of liquid has been dispensed from the container 20, the user need only release the pressure on the button cap 44, whereupon the spring 42 will return the bleed valve 36 and liquid drain valve 38 to their closed and sealed positions. Thus, the only time the air bleed valve 36 is opened is when the liquid drain valve 38 is also open. Conversely, whenever the liquid drain valve 38 is closed, the air bleed valve 36 is also closed. Therefore, only one bung hole 22 is required for the container 20 with no other openings. Further, when it is not dispensing liquid, the container can be horizontal, vertical, or upside down, and no liquid contents will leak from the container 20.

For filling or cleaning, the user need only unscrew the retainer ring or nut 24 from the bung hole 22 and remove the valve 10 from the opening. Thus, the container seat 12 can be used conveniently for filling, cleaning, carrying and dispensing liquid effectively with only one bung hole 22 provided therein.

Figure 5:
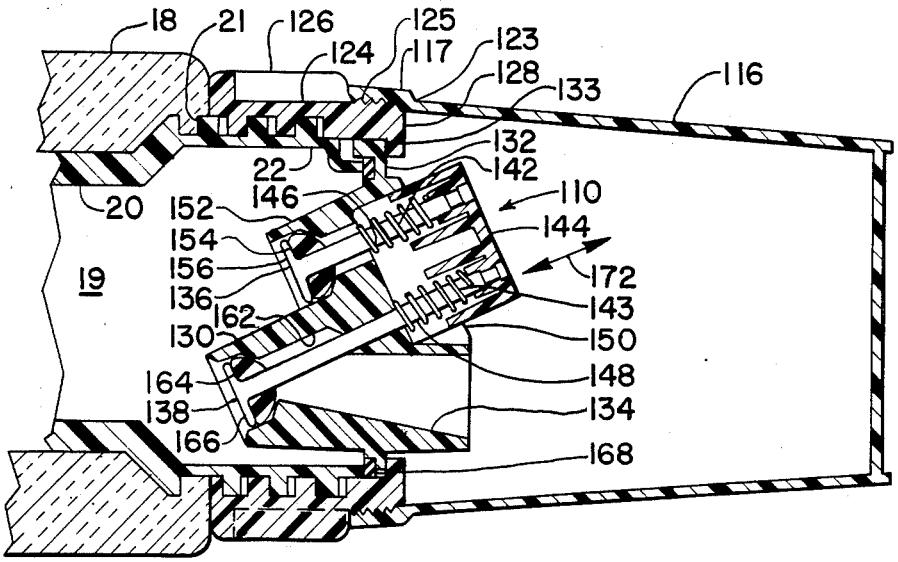
FIG. 5 is a cross-sectional view similar to the view of FIG. 4, but of an alternate embodiment of the valve and showing a cup attached over the valve in a storage position.

An alternate embodiment self-bleeding bung dispenser valve according to the present invention is shown in FIG. 5, which is a cross-section similar to FIG. 4 for the preferred embodiment. It is noted that a cup 116 with an internally threaded end 117 is shown screwed onto a threaded external end of the retainer nut 124 for storage while the cup 116 is not in use. While it is not so shown in FIG. 4, a similar mounting for a cup 16 can be provided on the nut 24. Also, the cup 116 can be sized to frictionally mount on the flanges 26 of the nut 24.

Referring now to FIG. 5, this alternative embodiment self-bleeding bung dispenser valve 110 according to the present invention is also mounted in the bung hole 22 of the container 20. The nut 124 screwed onto the external threads 21 of the bung hole 22 until the collar 128 abuts against the shoulder 132, thereby squeezing the gasket 168 against the end of the bung hole. Also, a notch 123 in the top of the bung hole 22 receives enlarged nub 133 to keep the valve body 130 in proper vertical orientation as the nut 124 is being attached.

The main valve body 130 in this embodiment includes a bleed conduit 152 extending at a downwardly inclined angle through the upper portion of the valve body 130. A similarly inclined liquid conduit 162 is bored into the lower part of the valve body 130. This liquid drain conduit 162 connects to a downwardly slanted spout 134 opening to the exterior of the valve body 130.

A bleed valve 136 is positioned in the bleed conduit 152, and a liquid drain valve 138 is positioned in the conduit 162. The bleed valve 136 is comprised of an elongated valve stem 146 extending through the conduit 152. A bleed valve seal 154 is positioned around the interior end of the valve stem 146 and retained thereon by a keeper 156. Likewise, the liquid drain valve 138 is comprised of an elongated valve stem 148 extending through the conduit 162 to the exterior of the valve body 130. A liquid valve seal 164 is positioned around the internal end of the valve stem 148 and retained in that position by a keeper 166 on the end of valve stem 148.

The external ends of both the bleed valve stem 146 and the liquid drain valve stem 148 are attached to a button cap 144 slideably positioned in the valve body 130. A coil spring 142 is positioned around the bleed valve stem 146 between the valve body 130 and the button cap 144. Similarly, a coil compression spring 143 is also positioned around the valve stem 148 between the valve body 130 and the button cap 144. These springs 142, 143 bias the button cap 144 outwardly, thereby pulling the seals 154, 164 against the valve body 130 at their respective openings to conduits 152, 162. In this manner, the bleed valve 136 and the liquid drain valve 138 are normally biased to the closed position.

In operation, when the user desires to dispense liquid from the container 20, the button cap 144 is pushed inwardly against the bias of springs 142, 143 to open the bleed valve 136 and liquid drain valve 138 simultaneously. When so opened, liquid is dispensed through the drain valve 138 and out the spout 134 while bleed air is taken in through vent hole 150 and bleed valve 136. Then, as in the preferred embodiment described above, as soon as the user releases the pressure from the button cap 144, the springs 142, 143 bias the cap outwardly as indicated by arrow 172 to close the bleed valve 136 and liquid drain valve 148 simultaneously.

The foregoing description is considered as illustrative only of the principles of the invention. Further, since numerous modifications and changes will readily occur to those skilled in the art, it is not desired to limit the invention to the exact construction an processes shown and described above. Accordingly, all suitable modifications and equivalents may be resorted to falling within the scope of the invention as defined by the claims which follow.

The embodiments of the invention in which an exclusive privilege is claimed are defined as follows:

1. Container seat apparatus, comprising:

a liquid container with a bung valve extending into the interior of the container from the exterior;

an insulated shell covering the container in the shape of a seat;

a bung valve positioned in said bung hole, said bung valve including a valve body enclosing a chamber, a first conduit and a second conduit both extending from the interior side of the valve body into said chamber, said second conduit being positioned above said first conduit, a first elongated valve stem positioned longitudinally moveable in said first conduit with a first seal mounted on one end of said first valve stem and positioned to seal against the interior side of the valve body, a second elongated valve stem positioned longitudinally moveable in said second conduit with a second seal mounted on one end of the second valve stem and positioned to seal against the interior side of the valve body, a button actuator slideably mounted in said valve body and connected to the other ends of both of said first and second valve stems in such a manner that movement of said button actuator causes simultaneous longitudinal movement of both of said first and second valve stems, spring means between said button actuator and said valve body for normally biasing said first and second seals in closed position against the valve body, an air vent extending from the exterior side of the valve body into the top of the chamber, and a spout extending from the bottom of said chamber to the exterior side of said valve body.

2. The container seat apparatus of claim 1, including an elongated plate in said chamber with each of said first and second valve stems being connected to said plate, and a main valve stem connected to said plate extends from said plate through a hole in said valve body to the exterior thereof, and said button actuator being attached to said main valve stem on the exterior side of said valve body.

3. The container seat apparatus of claim 1, wherein said valve body has a spout opening extending from the exterior side of said valve body into connection with said first conduit at an acute angle to said first valve stem with said button actuator being positioned a spaced distance above said spout opening.

4. The container seat apparatus of claim 1, including a threaded annular rim around said bung hole and wherein said valve body has an annular shoulder extending radially outward around its peripheral surface interface with said rim and a retaining nut with an annular collar removeably screwed onto said rim to retain said shoulder between said collar and said rim.

5. Self-bleeding bung valve apparatus for dispensing fluid through a bung hole that extends from the interior to the exterior of a container, comprising:

a valve body removeably secured in said bung hole with an interior side that faces the interior of the container and an exterior side that faces the exterior of the container, said valve body enclosing a chamber between the interior and exterior sides;

a first conduit extending partially through said valve body from the interior side into the bottom of said chamber;

a second conduit extending partially through said valve body from the interior side into the top of said chamber;

a first elongated valve stem positioned longitudinally moveable through said first conduit with first seal means mounted on one end of said first valve stem for closing said first conduit;

a second elongated valve stem positioned longitudinally moveable through said second conduit with second seal means mounted on one end of said second valve stem for closing said second conduit;

a button actuator slideably mounted in said valve body and connected to the other ends of both said first and second valve stems in such a manner that movement of said button actuator causes simultaneous longitudinal movement of both of said first and second valve stems;

spring means between said button actuator and said valve body for normally biasing said first and second seal means to their respective closed positions;

an air vent extending from the exterior side of said valve body into the top of the chamber; and a spout extending from the bottom of said chamber to the exterior side of said valve body.

6. The valve apparatus of claim 5, including an elongated plate in said chamber with each of said first and second valve stems being connected to said plate, and a main valve stem connected to said plate extends from said plate through a hole in said valve body to the exterior thereof, and said button actuator being attached to said main valve stem on the exterior side of said valve body.

7. The valve apparatus of claim 5, wherein said valve body has a spout opening extending from the exterior side of said valve body into connection with said first conduit at an acute angle to said first valve stem with said button actuator being positioned a spaced distance above said spout opening.

8. The valve apparatus of claim 5, including a threaded annular rim around said bung hole and wherein said valve body has an annular shoulder extending radially outward around its peripheral surface interface with said rim and a retaining nut with an annular collar removeably screwed onto said rim to retain said shoulder between said collar and said rim.

* * * * *